US005322222A

United States Patent [19]

Lott

[11] Patent Number: 5,322,222

[45] Date of Patent: Jun. 21, 1994

[54] SPIRAL JET FLUID MIXER

[76] Inventor: W. Gerald Lott, 1857 Park Oak Park Dr., Houston, Tex. 77027

[21] Appl. No.: 956,389

[22] Filed: Oct. 5, 1992

[51] Int. Cl.[5] ..... B05B 7/10; F04F 5/02

[52] U.S. Cl. ..... 239/403; 239/396; 239/430; 417/194; 417/198

[58] Field of Search ..... 239/399, 403, 404, 318, 239/390, 396, 429, 430, 433, 472, 428.5; 417/196, 198, 151, 194

[56] References Cited

U.S. PATENT DOCUMENTS

| | | | |
|---|---|---|---|
| 541,781 | 6/1895 | Wheeler | 417/151 |
| 1,890,708 | 12/1932 | White | 417/194 |
| 2,149,115 | 2/1939 | Foe et al. | 239/430 |
| 2,382,688 | 8/1945 | Wilson | 417/198 |
| 3,605,735 | 9/1971 | Soden | 239/472 |
| 3,688,511 | 9/1972 | Harmstrof | 239/318 |
| 3,840,183 | 10/1974 | Kuribayashi | 239/318 |
| 5,071,068 | 12/1991 | Suniewski | 239/403 |

*Primary Examiner*—Karen B. Merritt
*Attorney, Agent, or Firm*—Kenneth A. Keeling

[57] ABSTRACT

A spiral jet mixer for mixing fluids comprises an elongated body having a first inlet nozzle for introduction of a primary fluid, a mixing chamber having a diverging wall and a converging wall, a plurality of angled, helical passageways in the diverging wall for introduction of a secondary fluid into the mixing chamber in a spiralling turbulent, initially convergent flow pattern. Removable inlet nozzles allow a plurality of inlet nozzle orifice diameters.

14 Claims, 1 Drawing Sheet

SPIRAL JET FLUID MIXER

BACKGROUND OF THE INVENTION

1. Field of the Invention

The invention relates broadly to devices known as jet pumps. This invention relates particularly to an improved jet pump for intimately mixing a primary fluid with a secondary fluid.

2. Description of the Prior Art

There are a multitude of requirements in an industrial setting for the mixing of a first fluid with a second fluid within an environment. Applications include, for example, mixing of liquids within a tank, combustion processes, chemical reactions, heat transfer processes, environmental control systems, and sprayers. In various applications, including waste treatment, it is desirable additional or independently, to entrain gases, including air, within a liquid.

Jet pumps or eductors are currently used to mix a first liquid with a second liquid by introducing the first liquid into the second mixture at a relatively high pressure through a restrictive flow orifice. Both jet pumps and eductors are based on the Venturi principle and the Bernoulli effect relating to the phenomenon of internal pressure reduction with increased stream velocity in a fluid.

Various commercially available eductors are described in product brochures, including DEX (TM) Tank Mixing Eductors. GEA Wiegand GmbH discloses liquid jet mixers. Fox Venturi eductors are commercially available to mix particulate solids with air and to Convey the air/solid mixture through a discharge outlet. Penberthy discloses jet pumps for pumping gases and circulating tank eductors to mix liquids in open or enclosed tanks.

Von Ohain, et al., U.S. Pat. No. 3,525,474 discloses an eductor having a convergent inlet section, a mixing section, and a divergent diffuser section with nozzles injecting high velocity primary jet fluids into the inlet section and by aspirator action inducing a secondary flow into the inlet.

Chambers U.S. Pat. No. 3,371,618 discloses a jet pump including a mixing chamber having a substantially constant static pressure throughout the mixing chamber wherein the induced flow of secondary fluid into the chamber is in a direction generally parallel to that of the primary fluid with the angle of divergence of the mixing chamber being approximately equal to the angle of expansion of the primary fluid in the mixing chamber, thereby minimizing energy losses.

Svantesson U.S. Pat. No. 3,799,511 discloses a method of forming a solution of gas and liquid and introducing such solution into a body of liquid comprising mixing a gas and liquid at sufficient pressure and for a sufficient period of time and then introducing the mixture, free of turbulence, into the body of liquid below the liquid surface level.

Alperin U.S. Pat. No. 4,332,529 discloses a jet diffuser ejector constructed for maximum thrust augmentation with minimal length comprising multiple primary injection nozzles arranged in spaced relationship at preselected angles.

Ho, et al., U.S. Pat. No. 4,519,423 discloses an apparatus for mixing fluids having at least one non-circular orifice, the orifice having unequal major and minor axis dimensions, and the mixing region extending downstream a distance at least equal to the minor axis dimension.

Straub, et al., U.S. Pat. No. 4,792,284 discloses a device for creating a pressure difference in the flow of a fluid comprising a double cone, the double cone consisting of two co-axial hollow cones linked at their smallest faces. A lateral connection is provided at the narrowest point of the double cone linking the faces. A negative pressure at the narrowest point produces a sucking effect at the lateral connection.

Schreiber, et al, U. S. Pat. No. 4,818,446 discloses an apparatus for introducing a gas into a fluid in which a diffuser pipe or a perforated distributor hose is mounted on a gas supply pipe.

Tharp, U.S. Pat. No. 4,960,546, discloses an improved mounting bracket for mounting diffusers on submerged lateral air supply pipes in a wastewater treatment system.

Ealba, et al, U.S. Pat. No. 4,971,678 discloses a diffuser with a thin convoluted wall member disposed upstream of the inlet which generates vortices having axes in the downstream direction. The vortices enhance mixing within the diffuser. Tharp, U.S. Pat. No. 5,013,493, discloses a staggered diffuser arrangement for wastewater treatment systems in which tubular diffusers are arranged with short and long diffuser assemblies Emmett, Jr., et al, U.S. Pat. No. 5,057,284, discloses a reactor vessel for use of treating slurries which contains a mixer arrangement and an air supply arrangement.

Tharp, U.S. Pat. No. 5,059,358 discloses a tubular diffuser for a wastewater aeration system comprising a pipe having spaced-apart outlet ports and a porous membrane sleeved around the pipe for discharging air and bubbles and an adjustable plug which can be located at various locations within the pipe to provide buoyant and non-buoyant use of the diffuser.

It is an object of the present invention to provide an improved jet pump for intimately mixing a primary fluid with a secondary fluid.

It is another object of the present invention to provide an improved jet pump for intimately mixing a primary fluid with a secondary fluid within a relatively confined area.

It is another object of the present invention to provide an improved jet pump for mixing a primary fluid with a secondary fluid, the jet pump being disposed in an environment comprising the secondary fluid.

SUMMARY OF THE INVENTION

The spiral jet mixer of the present invention is an improved jet pump for mixing fluids. The spiral jet mixer comprises an elongated body having a first inlet nozzle for introduction of a primary fluid, the inlet nozzle containing a reduced-area opening, the inlet nozzle discharging the primary fluid into a mixing chamber, the mixing chamber having walls diverging from the inlet nozzle, the said diverging walls containing a plurality of inlet ports. The mixing chamber is further provided with convergent walls and a relatively reduced diameter section. A divergent diffuser section is provided downstream of the mixing chamber.

The inlet ports to the mixing section diverging walls are generally oriented in the direction of flow of the primary liquid. The inlet ports comprise helical passages providing fluid communication for the second fluid into the interior of the spiral jet mixer.

Introduction of a primary fluid through the said inlet nozzle at a high velocity and the subsequent diverging walls of the mixing chamber creates increased flow velocity and reduced static pressure at the inlet nozzle outlet thereby drawing the secondary fluid through the inlet ports.

The spiral arrangement of the inlet port helical passages causes spiralling rotation of the secondary fluid and thereby promotes spiralling rotation of flow of primary and secondary fluids downstream resulting in turbulent fluid motion. The turbulent fluid flow results in entrainment of the secondary fluid with the primary fluid.

Subsequent flow through the diffuser section results in continued diffusion and entrainment of the primary and secondary fluids.

A removable inlet nozzle insert is provided at the primary inlet port to allow for a variety of orifice diameters at the said inlet port.

DETAILED DESCRIPTION OF THE INVENTION

Figure 1:
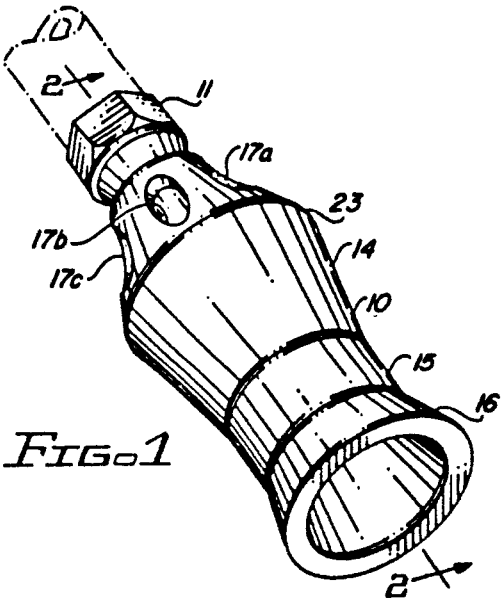
FIG. 1. depicts an isometric view of the spiral jet mixer of the present invention.
Figure 3:
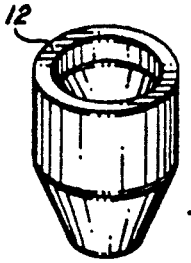
FIG. 3. depicts an isometric view of the inlet nozzle of the present invention.

Referring first to FIG. 1. an isometric view of the spiral jet mixer 10 of the present invention is shown. Generally the spiral jet mixer 10 comprises an elongated structure having a coupler 11 provided at a first end, radially divergent walls 13, a radially convergent wall section 14, a constant diameter section 15, and a radially divergent wall section 16. An insert nozzle 12, as depicted in FIG. 3, is provide for insertion at the coupler 11 end of the apparatus. A plurality of inlet ports designated 17*a*, 17*b* and 17*c* are provided in divergent wall 13. The inlet ports 17*a*, 17*b*, and 17*c*, will be referred to generically as inlet ports 17.

Figure 2:
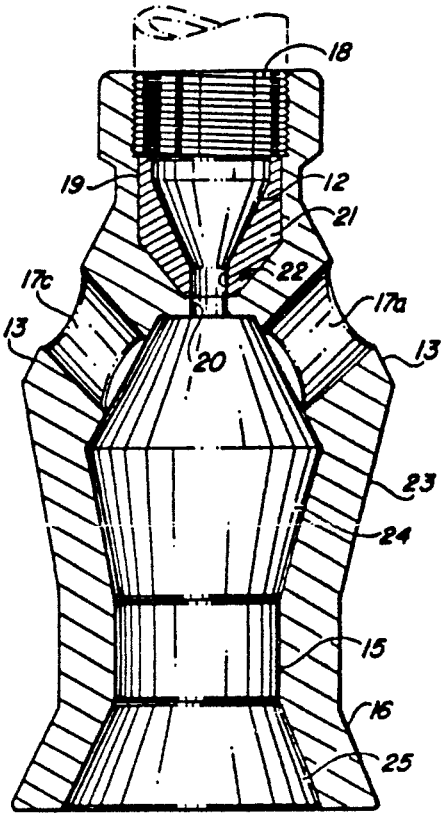
FIG. 2. depicts a cross-sectional view of the spiral jet mixer of the present invention.

Referring to FIG. 2., a cross-sectional view of the spiral jet mixer 10 of the present invention is depicted. Referring first to coupler 11, it is noted that the interior wall of coupler 11 is threaded for connection to an inlet pipe (not shown) for the introduction of a primary liquid (not shown) into the spiral jet mixer 10.

A cavity 19 is provided in the body of the spiral jet mixer 10 adjacent threads 18 of coupler 11, such cavity 19 having initially uniform diameter at the end adjacent threads 18 and converging to an inlet opening 20 at the distal end. Inlet nozzle 12 is provided with initially uniform outer diameter converging to a reduced diameter end 21. The exterior dimensions of insert nozzle 12 are so sized and constructed as to removably fit within the cavity 19 provided in spiral jet mixer 10. Insert nozzle 12 is hollow to allow fluid flow therethrough. An inlet orifice 22 is provided at the reduced diameter end 21 of insert nozzle 12.

Upon insertion of inlet nozzle 12 into cavity 19 and attachment of a threaded inlet pipe (not shown) into coupler 11, inlet nozzle 12 is restrained by the end of the inlet pipe to a fixed position within the cavity 19.

Referring still to FIG. 2., inlet opening 20 extends into a chamber defined by a round wall 23, such wall 23 comprising an initially divergent wall 13, a convergent wall 14, a constant diameter wall 15, and a radially divergent wall 16. In the preferred embodiment, wall 23 is symmetrical about the central axis of the spiral jet mixer 10.

Wall 23 therefore defines an interior chamber initially diverging from inlet opening 20, thereafter converging, thereafter having a constant diameter, and thereafter again diverging. The portion of the chamber defined by the diverging wall 13, converging wall 14, and constant-diameter wall 15 will be referred to herein as the mixing chamber 24. The interior area defined by diverging wall 16 will be referred to herein as the diffuser section 25.

A plurality of inlet ports 17 are provided in diverging wall 13. Inlet ports 17*a* and 17*c* are depicted in cross-sectional FIG. 2.

Inlet ports 17 are radially spaced around diverging wall 13. Inlet ports 17 extend between the exterior of the spiral jet mixer 10 and interior mixing chamber 24. The inlet ports 17 extend angularly through the diverging wall 13, the angle of the central axis of each inlet port 17 defining an acute angle with the central axis of the spiral jet mixer 10, the acute angle being open in the direction of the inlet opening 20.

Inlet ports 17, as depicted in the preferred embodiment shown in FIG. 2., are round openings providing fluid communication between the exterior of the spiral jet mixer 10 and the mixing chamber 24.

Referring briefly to the mode of operation of the preferred embodiment of spiral jet mixer 10, it should be understood that the spiral jet mixer 10, in operation, is placed within a liquid environment (not shown) . The liquid comprising the liquid environment is referred to herein as the second liquid. A threaded inlet pipe (not shown) is attached to coupler 11, the said pipe being connected at its distal end to a source of liquid to be mixed with the secondary liquid. The liquid introduced through the inlet pipe (not shown) is referred to herein as the primary liquid.

Figure 4:
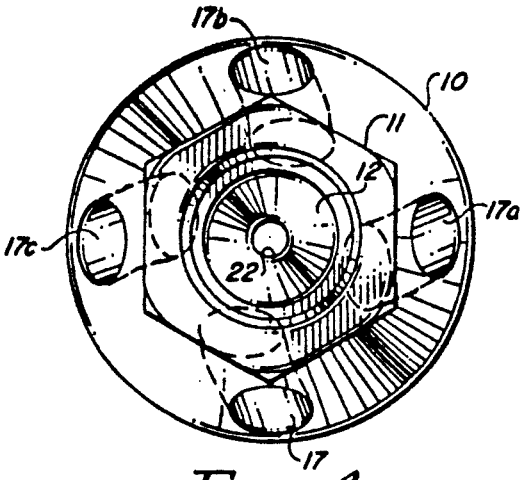
FIG. 4 depicts an end view of the spiral jet mixer of the present invention showing, in broken lines, the spiral passageways of the inlet ports and their intersection with the interior of the diverging wall.

The primary liquid is injected at relatively high pressure through the inlet pipe and the insert nozzle 12 (and thereby necessarily through the inlet opening 20 and inlet orifice 22) into mixing chamber 24 of the spiral jet mixer 10. As the primary fluid accelerates to flow through the inlet orifice 22, its static pressure decreases in accordance with the phenomenon observed in hydrodynamics that the pressure in a stream of fluid falls as the rate of flow increases (the Bernoulli effect). Upon passage of the primary fluid into the mixing chamber 24 with diverging wall 13 the velocity of the primary fluid gradually decreases from its maximum rate, which maximum rate occurs near the inlet orifice 22. The secondary fluid which is relatively static in relation to the primary fluid is at a higher static pressure than the static pressure of the primary liquid downstream of the inlet orifice 22. The secondary liquid is thus induced through inlet ports 17 into the relatively lower pressure region of the mixing chamber 24. Referring to FIG. 4, the various inlet ports 17 are, as previously indicated, constructed such that the central axis of each inlet port 17 is at an acute angle with the central axis of the spiral jet mixer 10. Each of the inlet ports 17 is additionally constructed with a spiral passageway. The axis of each inlet port 17 passageway is slightly curved such that when considered circumferentially in relation to the diverging wall 13, the central axis of each inlet port 17 at the exterior surface of diverging wall 13 is in a spaced relationship to the central axis of the said inlet port 17 at the inner surface of diverging wall 13. Each of such spiral inlet port 17 passageways is oriented in like manner. The inward flow of the secondary liquid into the mixing chamber 24 is thereby induced in a spiral manner at an acute angle to the flow of the primary liquid, thereby creating a vortex within the mixing chamber. The axis of the vortex is more or less coincident with the central axis of the radial wall 23.

The spiralling flow of primary and secondary fluids within mixing chamber 24 and resulting turbulence serves to effectively mix the primary and secondary fluids In the preferred embodiment, the inlet ports are round. However, they may be constructed of various configurations.

In the preferred embodiment, the angle of the inlet ports in relation to the central axis of the radial wall 23 is between 45 and 60 degrees. The extent of deviation of the central axis of each inlet port 17 at the outer surface of divergent wall 13 in relation to the inner surface of divergent wall 13 is approximately 15 to 30 degrees circumferentially.

The spiralling flow of the combined primary and secondary liquid continues through the portion of mixing chamber 24 defined by the constant diameter wall into diffuser section 25. The velocity of the liquid mixture decreases at the diffuser section 25 and the static pressure increases.

The converging streams of the primary and secondary fluids produce pressure fluctuation and intense turbulence within the mixing chamber 24 that provide highly efficient mixing within a small space. As the mixed liquid is conveyed through mixing chamber 24 into the diffuser section 25 the mixture continues in a spiralling, highly turbulent mode resulting in increased mixing of the primary and secondary liquid.

The velocity of the primary liquid at the inlet opening 20 may be adjusted by insertion of a variety of insert nozzles 12 each having various inlet orifice diameters.

The extent of the spiralling effect and the velocity of secondary liquid induced into mixing chamber 24 may be varied by variations in number, size, angle in relation to the axis of flow of primary liquid, and extent of spiral of inlet ports 17.

In the preferred embodiment, as depicted in FIGS. 1. and 2., the flow induced in the mixing chamber 24 results in a spiralling flow convergent at or near the constant diameter wall 15 and continuing a spiralling flow through diffuser section 25. As the mixture of primary and secondary fluids emerges from the diffuser section 25 a turbulent plume further mixes with the secondary liquid comprising the environment of the spiral jet mixer 10.

The spiral jet mixer of the present invention provides an efficient means of mixing a primary fluid with a secondary fluid which mixing effect is enhanced by the highly turbulent flow developed by the unique arrangement of the inlet ports 17 and further enhanced by the structure of the mixing chamber 24 and further enhanced by the diffuser section 25.

The preferred embodiment shown is specifically useful in mixing a primary liquid with a secondary liquid while disposed in an environment comprising the secondary liquid. The invention is readily adaptable for mixing a variety of fluids, including gases.

The preferred embodiment of the present invention may be further adapted for use other than in an environment comprising the secondary fluid by providing pipe or other inlet means connected to inlet ports 17. Flow through inlet ports 17 in such an arrangement may result from induction as described in the preferred embodiment or may result from pressure provided to the secondary fluid.

This invention has been shown and described with respect to preferred embodiments thereof. It will be understood by those skilled in the art that various changes in the form and detail thereof may be made without departing from the spirit and scope of the claimed invention.

I claim:

1. An apparatus for mixing fluids comprising:

a mixing chamber comprising an axially elongated housing for mixing fluids, said axially elongated housing having an axis;

primary inlet means for injecting a primary fluid into the mixing chamber at a first upstream end thereof;

discharge means at a distal downstream end of the mixing chamber;

secondary inlet means for fluid communication of a secondary fluid into the mixing chamber;

said axially elongated housing including a section radially divergent, in the direction of fluid flow, adjacent to and downstream of the primary inlet means;

the primary inlet means comprising an inlet nozzle axially aligned and directing flow of the primary fluid axially within the mixing chamber in the direction of the discharge means;

said secondary inlet means disposed in said radially divergent section downstream of said inlet nozzle;

the secondary inlet means disposed at an acute angle in relation to the elongated housing axis;

the secondary inlet means comprising at least one passageway having at least one passageway axis transverse to the housing axis that is not straight;

whereby said secondary inlet means in relation to said primary means creates spiralling, turbulent flow of the mixture of the primary fluid and the secondary fluid within the mixing chamber.

2. The apparatus of claim 1 wherein the at least one passageway axis is curved in a direction transverse to the elongated housing axis.

3. The apparatus of claim 1 wherein the at least one passageway axis is spiralled.

4. The apparatus of claim 3 wherein flow through the at least one passageway is induced by flow through the inlet nozzle.

5. The apparatus for mixing fluids comprising:

an axially elongated housing having an axis, a first upstream inlet end and a second downstream discharge end;

a primary inlet means at the inlet end for injecting a primary fluid into the housing along the axis of the housing in the direction of the discharge end;

secondary inlet means for fluid communication of a secondary fluid into the housing;

said primary inlet means comprising an inlet nozzle aligned with the housing axis;

the axially elongated housing including a section radially divergent, in the direction of fluid flow, adjacent to and downstream of the primary inlet means and a section radially convergent, in the direction of the fluid flow, adjacent to and downstream of the radially divergent section;

said secondary inlet means disposed in said radially divergent section downstream of said inlet nozzle;

the secondary inlet means comprising a plurality of passageways located in the said radially divergent section and located circumferentially therein;

the plurality of passageways having passageway axes which are oriented at an acute angle to the elongated housing axis;

the passageway axes of the plurality of passageways being curved transversely to the elongated housing axis;

whereby said secondary inlet means is so oriented in relation to the primary inlet means that the resultant flow of primary and secondary fluids within the housing is spiralling and turbulent.

6. The apparatus according to claim 5 wherein said plurality of passageways comprise a plurality of uniform helical passageways uniformly spaced and uniformly oriented in said radially divergent section.

7. The apparatus according to claim 5 wherein the elongated housing is contained in an environment comprising the secondary fluid;

the inlet nozzle includes a reduced-area section providing relatively high velocity of flow of the primary fluid; and the relatively high velocity of the primary fluid in relation to the secondary fluid creates a pressure differential within the housing thereby inducing flow of the secondary fluid into the housing.

8. The apparatus according to claim 7 wherein the axially elongated housing contains a constant-diameter section adjacent the radially-convergent section;

the axially elongated housing contains a second section radially divergent, in the direction of fluid flow, adjacent the constant-diameter section;

whereby the flow of the primary fluid and secondary fluid through the constant diameter section to the second radially divergent section results in a differential pressure between the mixture of the primary and secondary fluids and the environmental secondary fluid.

9. The apparatus according to claim 5 wherein the primary inlet means includes an inlet chamber for removable insertion of the inlet nozzle, said inlet nozzle retained in said inlet chamber by an abutting end of a pipe threadably engaged with a threading provided in said inlet chamber.

10. The apparatus according to claim 9 wherein a plurality of inlet nozzles are provided having variously-sized reduced-area outlet ends for sequential insertion in the chamber to provide various flow velocities of the primary fluid.

11. An apparatus for mixing fluids comprising:

an axially elongated housing, having an interior, an axis, a first upstream inlet end and a second downstream discharge end, disposed in an environment including a secondary fluid;

a primary inlet means at the inlet end for injecting a primary fluid into the housing in the direction of the discharge end;

secondary inlet means for fluid communication of the secondary fluid with the interior of the housing;

the axially elongated housing including a section radially divergent, in the direction of fluid flow, adjacent to and downstream of the primary inlet means and a section radially convergent, in the direction of fluid flow, adjacent to and downstream of the radially divergent section;

the secondary inlet means comprising a plurality of uniform, circumferentially spaced passageways located in the said radially divergent section;

said passageways having axes oriented at an acute angle to the housing axis;

the axes of said passageways are curved transversely to the housing axis;

the primary inlet means includes an inlet chamber for removable insertion of an inlet nozzle, the said inlet nozzle containing a relatively reduced-area outlet end, said inlet nozzle retained in said inlet chamber by an abutting end of a pipe threadably engaged with a threading provided in said inlet chamber;

the reduced-area outlet end of the inlet nozzle providing relatively high velocity of flow of the primary fluid; and the relatively high velocity of the primary fluid in relation to the secondary fluid creating a pressure differential within the housing thereby inducing flow of the secondary fluid into the housing.

12. The apparatus according to claim 11 wherein the secondary inlet means plurality of passageway axes are spiralled.

13. The apparatus according to 11 wherein the secondary inlet means plurality of passageways are

14. The apparatus according to claim 11 wherein a plurality of inlet nozzles are provided having variously-sized reduced-area ends for sequential insertion in the chamber to provide various flow velocities of the primary fluid.

* * * * *